US007591035B2

(12) United States Patent
Guo

(10) Patent No.: US 7,591,035 B2
(45) Date of Patent: Sep. 22, 2009

(54) BED WITH MOVABLE MATRESS

(75) Inventor: Fuling Guo, 3156 Cedar Grove Dr., Fairfax, VA (US) 22031

(73) Assignee: Fuling Guo, Fairfax, VA (US)

( * ) Notice: Subject to any disclaimer, the term of this patent is extended or adjusted under 35 U.S.C. 154(b) by 432 days.

(21) Appl. No.: 11/528,610

(22) Filed: Sep. 28, 2006

(65) Prior Publication Data

US 2007/0143924 A1 Jun. 28, 2007

Related U.S. Application Data

(63) Continuation-in-part of application No. 11/443,216, filed on May 31, 2006.

(60) Provisional application No. 60/752,493, filed on Dec. 22, 2005, provisional application No. 60/798,324, filed on May 8, 2006.

(51) Int. Cl.
*A61G 7/00* (2006.01)
*A61G 7/012* (2006.01)

(52) U.S. Cl. ..... 5/600; 5/611; 5/11

(58) Field of Classification Search ..... 5/608, 5/609, 607, 611, 601, 600, 108, 109, 11
See application file for complete search history.

(56) References Cited

U.S. PATENT DOCUMENTS 4,761,000 A * 8/1988 Fisher et al. ..... 5/608
5,013,018 A * 5/1991 Sicek et al. ..... 5/601
6,094,760 A * 8/2000 Nonaka et al. ..... 5/601
7,120,223 B2 * 10/2006 Nafstadius ..... 378/20
7,181,792 B2 * 2/2007 Nakamura et al. ..... 5/601
2004/0057557 A1 * 3/2004 Nafstadius ..... 378/209
2005/0028280 A1 * 2/2005 Nakamura et al. ..... 5/601
2007/0143923 A1 * 6/2007 Guo ..... 5/608
2007/0143924 A1 * 6/2007 Guo ..... 5/608
2009/0144902 A1 * 6/2009 Baumann et al. ..... 5/608
2009/0185663 A1 * 7/2009 Gaines, Jr. ..... 378/209

* cited by examiner

*Primary Examiner*—Robert G Santos

(57) ABSTRACT

A bed comprises a plurality of cables allowing a plate to be suspended in the air, a mattress sitting on the plate, a skeleton supporting the plate, a foundation supporting all of the above components and the human body or bodies lying on the bed. The cables may be slantways or vertically installed from superiority to inferiority. The bed also comprises means displacing support components in longitudinal direction and transverse direction separately relative to the foundation. Moreover, it also provides a method for initiating sleep by providing appreciate stimulation to vestibular organs. The method includes providing a support member to support an individual or individuals, controlling the displacement of the support member in a longitudinal direction or/and a transverse direction. The motion form of the bed is rhythmic reciprocal comprehensive motion: three dimensions with or without a seesawing motion which is most conducive to sleep occurrence and maintenance.

19 Claims, 15 Drawing Sheets

BED WITH MOVABLE MATRESS

CROSS REFERENCE TO RELATED APPLICATIONS

This application is a Continuation-in part of U.S. Non-provisional Utility Application Ser. No. 11/443,216, filed May 31 2006, which acclaims the benefit of U.S. provisional application Nos. 60/752,493 filed Dec. 22, 2005 and 60/798,324 filed May 08, 2006. The disclosures of the utility application and the previous filed applications are herein incorporated by reference.

BACKGROUND OF THE INVENTION

1. Field of the Invention

The invention relates generally to beds and more specifically, to a bed configured to oscillate in three dimensions with or without seesawing motion.

2. Description of Related Art

A large portion of people complain that they have to lie down on a bed for a long time before they fall asleep; that they can not fall asleep again after they wake up during the night; or that they wake up early and can not fall asleep again in the early morning. In addition, many people suffer from insomnia or other sleep problems caused by physical or mental diseases. According to statistics, one fourth of the population suffers from insomnia; in adults over 76 years old, 29% of men and 37% of women have sleep problems. Drugs used for insomnia have certain limitations because of their side effects, which inhibit the action of the central nervous system for a certain period of time and can therefore affect a person's life quality. Moreover, there are considerations of drug-dependence that must be considered.

It is obvious that sleep is vitally important for human physical and mental health and therefore the sleep mechanism is an issue that is worth exploring and continuing to explore. Experiments involving lack of sleep suggest that sleep allows the body to rest and repair itself. Therefore, a new and effective hypnotherapy technology would be highly desirable.

The effect of some of the so-called hypnotherapies is questionable. One example is music hypnotherapy that relies on an aural stimulus, which only acts on the cochlear nerves and locally stimulates the certain cerebral cortex and the stimuli is excitative to the brain. Some special beds have been used in hospitals that have a special mattress and bed skeleton. However, the function of the bed is not mainly to treat insomnia but mainly to prevent patients who are unconscious or who have difficulty changing their posture from bedsores and pneumonia.

Traditional understanding of sleep in humans assumes that the quietness of the environment is an important factor. In conjunction with this assumption, it is the belief that a generally steady sleep surface is beneficial. However, this is an issue that merits further consideration. Actually a proper form and quantity of movement is an effective stimulation for promoting sleep and maintaining sleep based on the following existences. One example which I call cradle effect is a child being rocked in a cradle or rocked by a parent in the parent's arms. Another example which I call trip effect is when people fall asleep while traveling by a carriage, car, ship or train. The third example is that sleepiness caused by vehicle jolt is a major cause of serious traffic accidents proved by traffic accident surveys (Department of Human Science, Loughborough University Tel: +44-1509-223091) which belongs to the scope of the trip effect. In addition, generally, people change their posture a few times after they lie down and before they fall asleep.

Vestibular organs including the utricle, the saccule and the semicircular canals are traditionally understood as balance sense organs that are involved in evaluating the position of the head relative to gravity, liner acceleration or deceleration, and the movement of the head. Vestibular organs function to make human to sense posture, position and movement to maintain body balance. However, based on the above explanations, the vestibular organs are also sleep organs.

Based on study of sleep history, exquisite observation of human life and continuous exploration of sleep mechanism, applicant thinks that sleep mechanism consists of two contents that we may call sub-mechanisms: (1)the sleep initiation mechanism and (2)the sleep maintenance mechanism. Sleep occurrence is a process of a consciousness state entering a sleep (we call none or very low level consciousness) state and is triggered by the sleep initiation mechanism. Sleep occurrence depends on conditions both from outside and inside of the body. That is, both the environment and some organs of the body contribute the sleep initiation. As such, sleep occurrence is a conditioned reflex. Generally, the sleep maintenance mechanism is a natural, cerebral function program that is procedurally controlled by the brain although it is affected by conditions from inside and outside the body at a certain degree.

A factor affecting sleep initiation is motion sensed by the body. The proper motion is a motion that simultaneously satisfies two conditions: (1) quality: proper motion form that continuously stimulates vestibular organs—there are two motion forms: rhythmic and rhythm-less; (2) quantity: proper motion intensity that will not cause muscles, especially extremity muscles, to contract in an attempt to maintain body balance and will not cause excessive reaction of parasympathetic excitation. The proper motion gives appropriate stimuli to vestibular organs thereby promoting the occurrence of sleep.

Based on the foregoing information, I have established a theory about the mechanism of sleep occurrence. The content of the theory includes: sleep occurrence is a conditioned reflex relying on the vestibular organs; the vestibular organs are sleep sense organs that include the utricle, the saccule and the semicircular canals; and the brainstem and basal forebrain form the sleep center. Proper motion stimulates the vestibular organs; the hair cells of the vestibular organs are activated and create action potential which is a sleep signal; the sleep signal is transferred to a sleep center in the brainstem and the basal forebrain via the afferent neuron tract of vestibular nerve nucleus; the neurons of the sleep center are activated and sleep onset is triggered. Besides the above, vestibular nerve broadly connects with other structures, such as vagus nerve nucleus, which may provide more benefit for sleep and for human' health.

Therefore, it is desirable to provide a new method that moves in such a manner as to act on the sleep initiation mechanism and the sleep maintenance mechanism by proper stimulation of the vestibular organs and promote sleep initiation and help sleep maintenance

BRIEF SUMMARY OF CERTAIN EMBODIMENTS OF THE INVENTION

The vestibular organs play a role of sleep sense organs is the theoretic basis for the invention. The apparatus is different from a traditional bed in that: (1) its mattress and support plate (plate) below the mattress are movable. Once sleep starts or shortly after sleep starts, the mattress and the plate of the apparatus can be controlled to cease movement and acts as a normal bed or to vary the amplitude of movement to assist sleep maintenance; (2) the plate and the mattress is suspended in the air. As an apparatus for a hypnotherapy, the bed is different from other hypnotherapies in that it stimulates directly the sleep sense organs-vestibular organs and actively induces sleep occurrence which the effect is positive. Compared with other hypnotics, the invention has no side effect when the motion state is proper by maintained at certain intensity and form of the motion adjusts depending upon the person.

The plate which supports the mattress of the bed rhythmically moves forward and backward in three dimensions with or without seesawing motion, which provides an appropriate motion stimuli to the vestibular organs of inner ears. The stimulation to the vestibular nerves causes sleepiness and promotes sleep occurrence. The plate situated on an inner skeleton (skeleton). One end of at least four suspended cables (cables) connects to the outer inferior edge of two opposite sides of the skeleton and another end of cables connects to the inner superior edges of two opposite sides of a foundation. There are two motors sited on the bottom of the foundation of the bed that drive the skeleton to move. The motion created by bed is proper for a physical person. The "proper" motion contains three contents: 1) effective stimulation to the vestibular organs; 2) no reaction of balance adjustment which means the motion does not cause muscle contraction, especially extremity muscle contraction or body is in the posture that is unnecessary for muscle contraction to maintain balance; 3) no excessive reaction of the vagus nerves, such as nausea or/and vomiting. The user can choose the proper intensity and expectant motion fusion by a control panel fixed on the bed or a remote control device. The bed promotes sleep occurrence and maintains sleep. The bed also provides more comfort than a common bed. The bed is useful for all people, especially for people who have insomnia. It may benefit the patient who is unconsciousness or has difficulty changing his or her posture to prevent bedsores or pneumonia.

Tow exemplary embodiments are described as follow.

First exemplary embodiment: a mattress and a plate below the mattress are supported by a skeleton. One end of cables connects with the outer inferior edge of two long opposite sides of the skeleton and the other end of the cables connects with the inner superior edge of two opposite long sides of a foundation. The actual effect is that the mattress and plate situated on the top surface of the skeleton is suspended in the air. The cables run slantways from the inner inferior position at the inferior edge of the skeleton to the outer superior position at the superior edge of the foundation. So the two opposite sides of the mattress and the plate surface will be raised and lowered alternatively in the vertical direction at the transverse view when the bed moves fro and to in the transverse direction. The surface of the mattress and plate will move up and down alternatively in the vertical direction at the longitudinal view when the bed moves fro and to in the longitudinal direction. The first exemplary embodiment has the most complex motion form: three dimension motion+ seesawing motion. Two motors provide motion power: one drives the mattress sited on the plate through the skeleton to move fro and to in the transverse direction and another motor drives the mattress sited on the plate through the skeleton to move fro and to in the longitudinal direction. Control panel or remote control device is for user to choose motion parameters.

Second exemplary embodiment: A mattress and a plate below the mattress are supported by a skeleton. One end of cables connects with the outer inferior edge of the skeleton and other end of the cables with inner superior edge of foundation. The cables run vertically from the inner inferior edge of two opposite long sides of skeleton to the outer superior edge of the two opposite long sides of foundation when the bed is at lowest potential status. The actual effect is that the mattress and plate situated on the skeleton are suspended in the air. The most complex motion form of this exemplary embodiment is three dimensions. Two motors provide motion power: one drives the mattress sited on the plate through the skeleton to move fro and to in the transverse direction and another drives the mattress sited on the plate through skeleton to move fro and to in the longitudinal direction. Control panel or remote control device is for the user to choose motion parameters.

We can design various motion forms by adjusting the rate of rotation of the two motors because the actual sense of user to the combination of the motions is a resultant motion.

Further advantages and scope of applicability of the present invention will become more clearly apparent from the consideration of the drawings and ensuing detailed description given hereinafter. It should be understood, however, that the detailed description and specific examples, while indicating preferred embodiments of the invention, are given by way of illustration only since various changes and modifications within the spirit and scope of the invention will become apparent to those skilled in the art from the detailed description.

BRIEF DESCRIPTION OF THE DRAWINGS

The present invention will become better understood from the detailed description given herein below and the accompanying drawings that are given by way of illustration only, and do not limit the present invention and wherein.

DETAILED DESCRIPTION OF THE INVENTION

Figure 1:
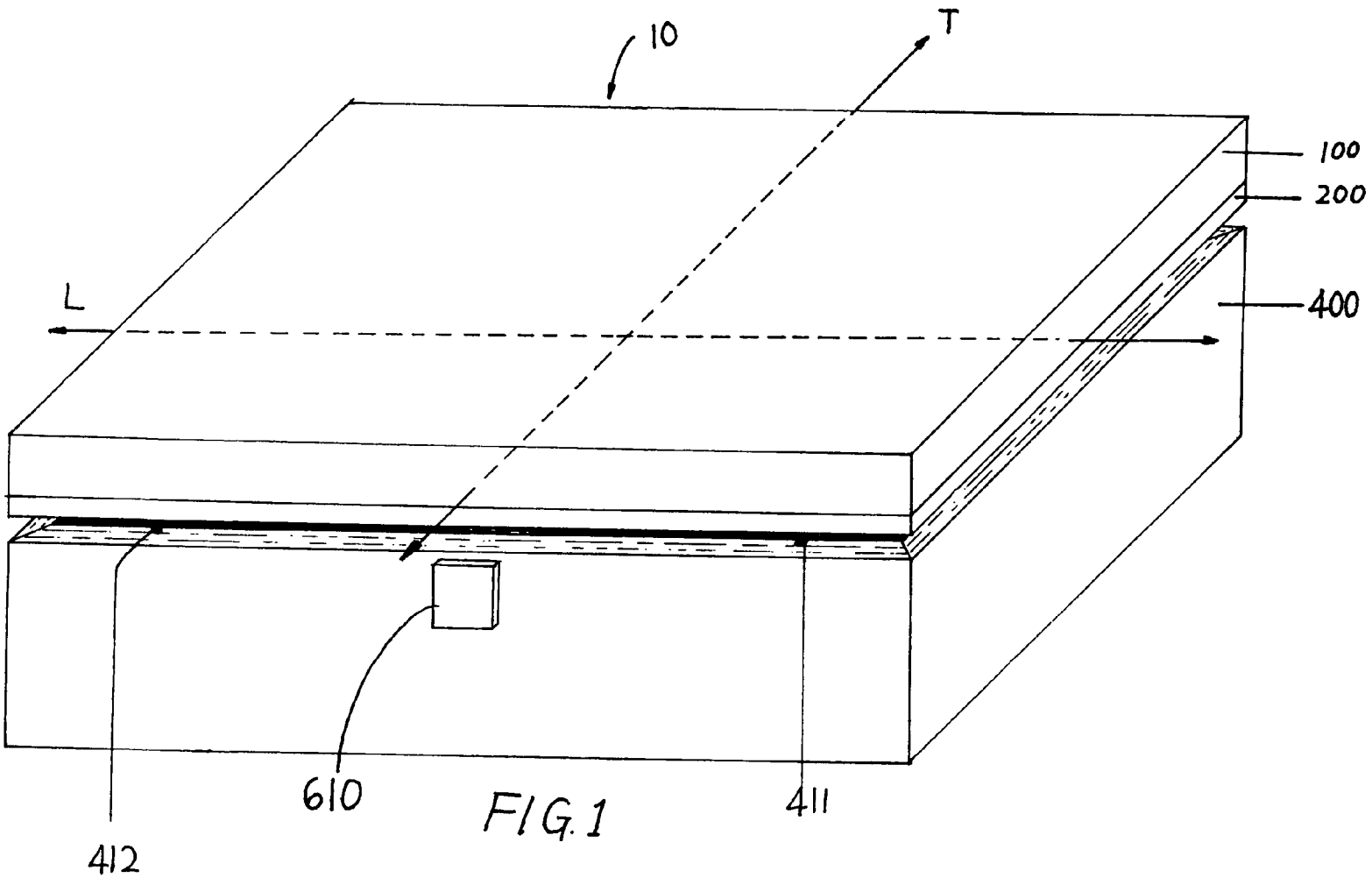
FIG. 1 is a perspective schematic view of first exemplary embodiment of the bed.
Figure 2:
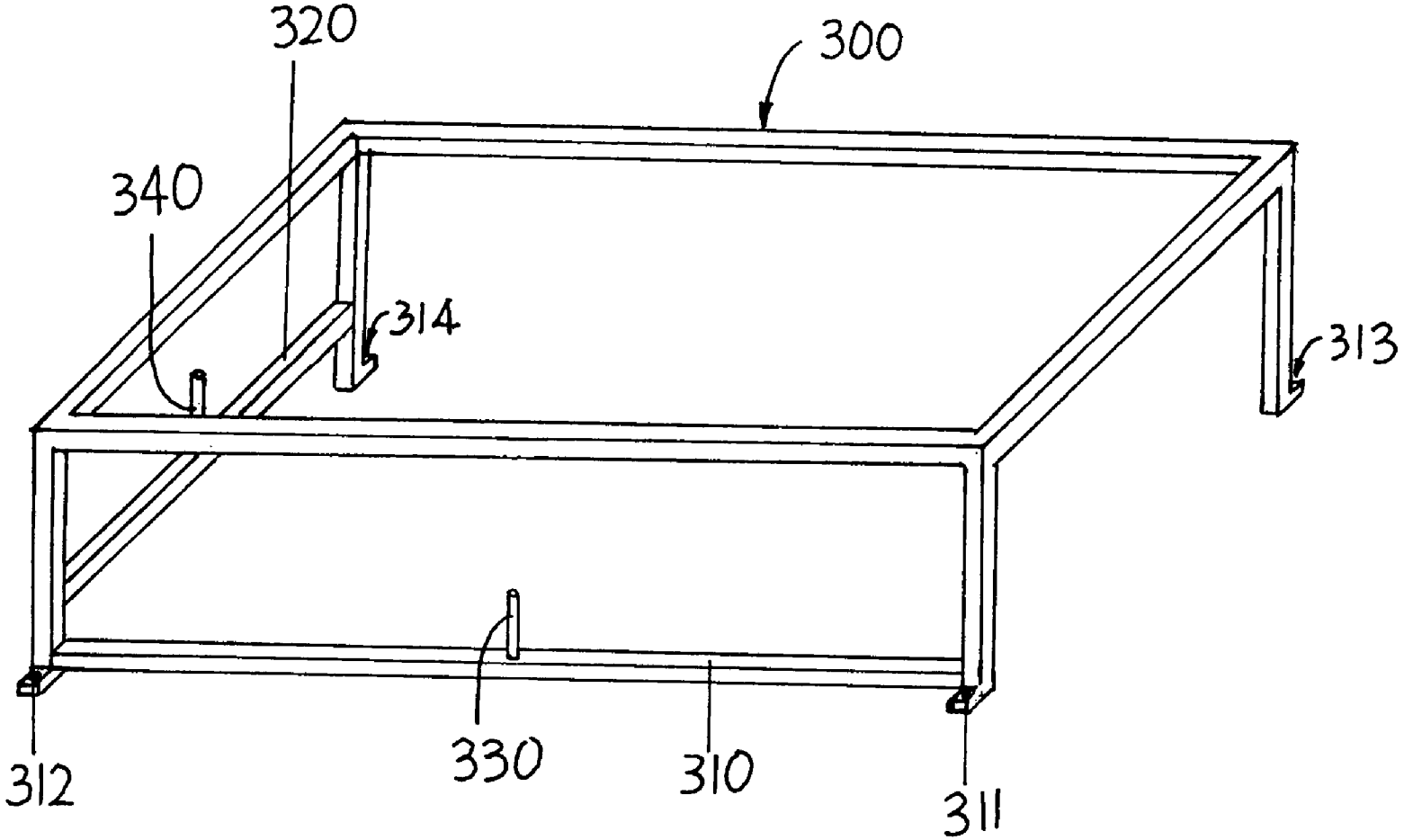
FIG. 2 is a perspective view of a first embodiment of a skeleton for the bed of FIG. 1 looking from above.

A first exemplary embodiment of a bed 10 is shown in FIGS. 1-7. As seen in FIG. 1 and FIG. 2, the bed 10 includes a mattress 100, a support plate (plate)200, an inner skeleton (skeleton)300 (see FIG. 2)that support the plate 200, 4 suspended cables (cables) 500(see FIG. 6), and a foundation 400 (or call outer skeleton or pedestal). As shown, the bed 10 is designed to allow the mattress to be moved in a longitudinal direction L and/or a transverse direction T accompanying vertical up and down motion of mattress plane and with or without seesawing motion with respect to the foundation 400 and will be described in further detail below. The motion of the mattress will stimulate the vestibular organs and assist in the sleep initiation and sleep maintenance.

Although the mattress 100, the plate 200, the skeleton 300, and the foundation 400 are shown as separate components, it is understood that one or more of these components can be combined into a single component. For example, the mattress 100 and the plate 200 could be provided as a single reinforced mattress.

For purposes of this invention, the mattress 100 can be any conventional mattress, such as, for example, a foam mattress, an air mattress, a spring mattress, a water-filled mattress, or any other mattress that is designed to support a body or bodies in a supine position and to provide a comfortable surface for a body or bodies. As shown in FIG. 1, the mattress 100 is supported on a plate 200.

Plate 200 is formed from any suitable planar material that is strong enough to support the weight of a body or bodies plus the weight of the mattress 100. The plate has an upper surface (not shown) that contacts the mattress 100 and a lower surface (not shown) that site on a skeleton 300(see FIG. 2).

As seen in FIG. 2, the skeleton is a bench-like structure. There is a hole at the free end of each foot of the skeleton. The total number of the holes is 4 that are numbered as 311,312, 313 and 314. The holes are positions for one end of a cable 500 (see FIG. 4A and FIG. 6) to connect with. A beam 310 is between two feet in the longitudinal view. A pivot 330 is at the middle of the beam 310 that is a jointed connection position for one end 444 of a linkage arm 442(see FIG. 4B). Another beam 320 is between two feet in the transverse view. A pivot 340 is at the middle of the beam 320 that is a jointed connection position for one end 464 of a linkage arm 462(see FIG. 5).

Figure 6:
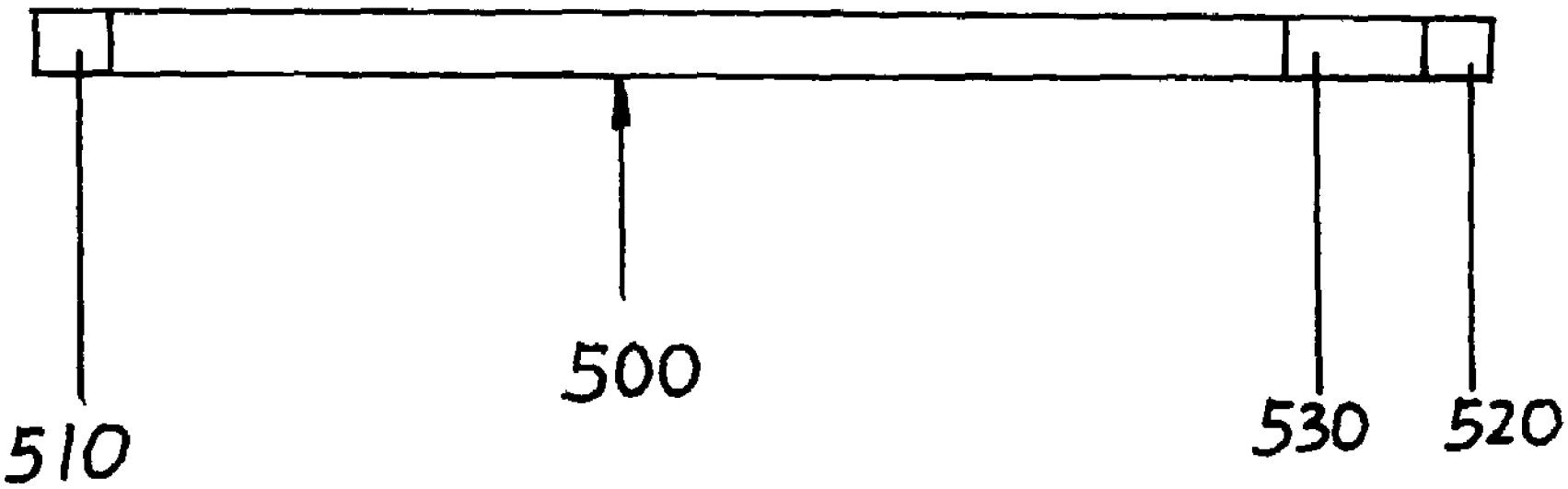
FIG. 6 is a schematic representation of a cable.

As seen in FIG. 6, for purposes of this invention, the cables 500 may be made of any of materials, such as string, metal chains, metal sticks that satisfy the requirements: (1) bearing the weight of the skeleton, the plate, the mattress and human body or bodies; (2) anti-extension. Each cable has two ends 510,520 that connect or joined-connect with the skeleton and with foundation separately. Each cable also has a length adjustor 530. In the first embodiment, the cables 500 are installed slantways from inner superior position of each of two opposite long planks 410,420 of the foundation 400 to outer inferior position of each of two opposite long sides of the skeleton 300 at the transverse view (see FIG. 4A). As such, there is a component of seesawing motion when mattress moves fro and to reciprocally in the transverse direction.

Figure 3:
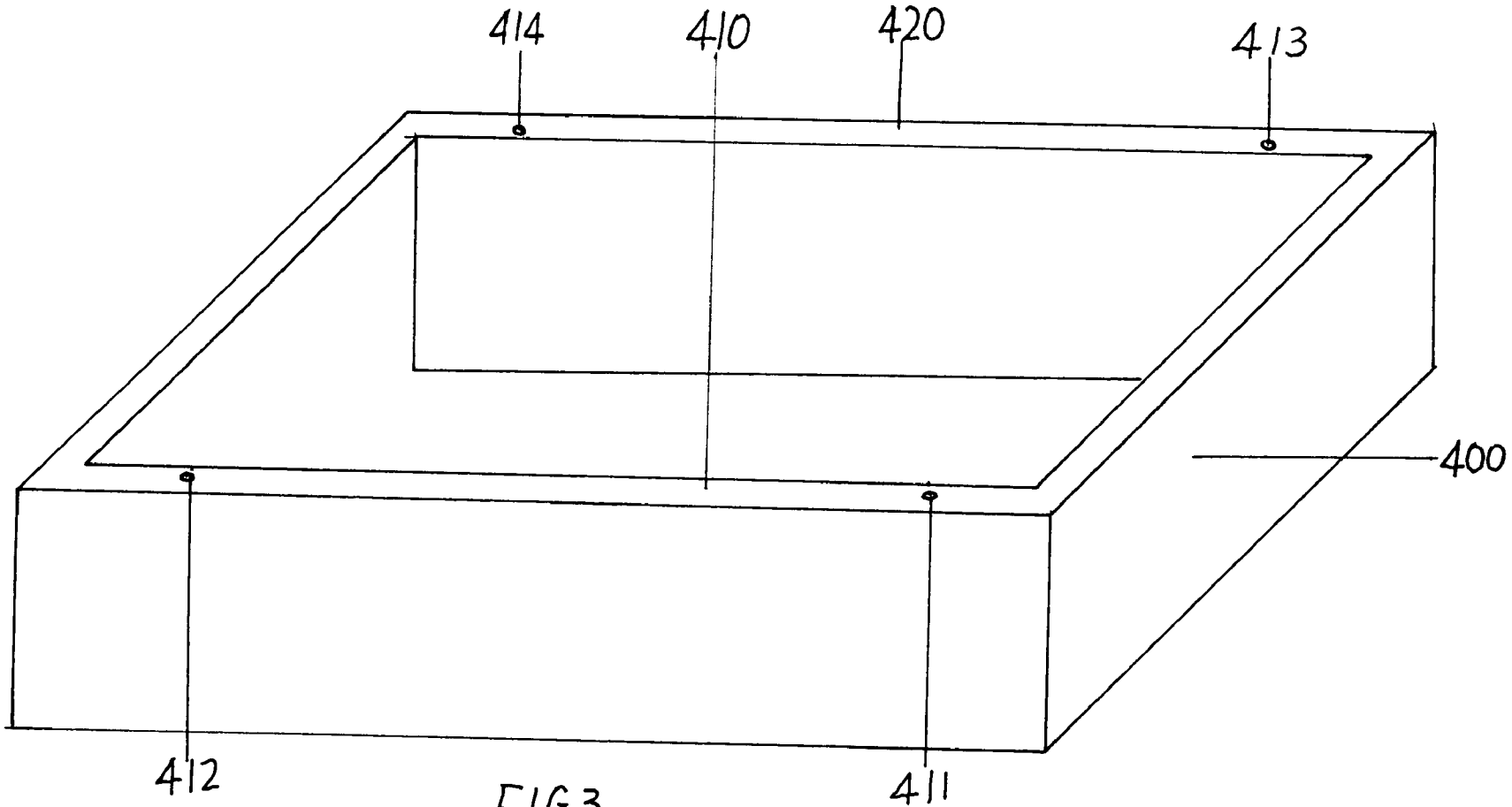
FIG. 3 is perspective views of a first embodiment of a foundation for the bed of FIG. 1 looking from above.

As seen in FIG. 3, foundation 400 is a box-like with top opening structure. It may be made of plastic or wood or metal or any combination thereof. The bottom may be a plate or a frame structure. Whatever the structure of the bottom, its purpose is just for motors 430 and 450 (see FIG. 4B and FIG. 5) to site on. There are 4 holes that are positions for another end of cables 500 (see FIG. 4A and FIG. 5) to connect to at the inner superior position of both opposite long planks 410, 420 of the foundation 400. Two holes numbered 411 and 412 are at the inner superior position of one long plank 410. Other two holes numbered 413 and 414 are at the inner superior position of other long plank 420.

Figure 4A:
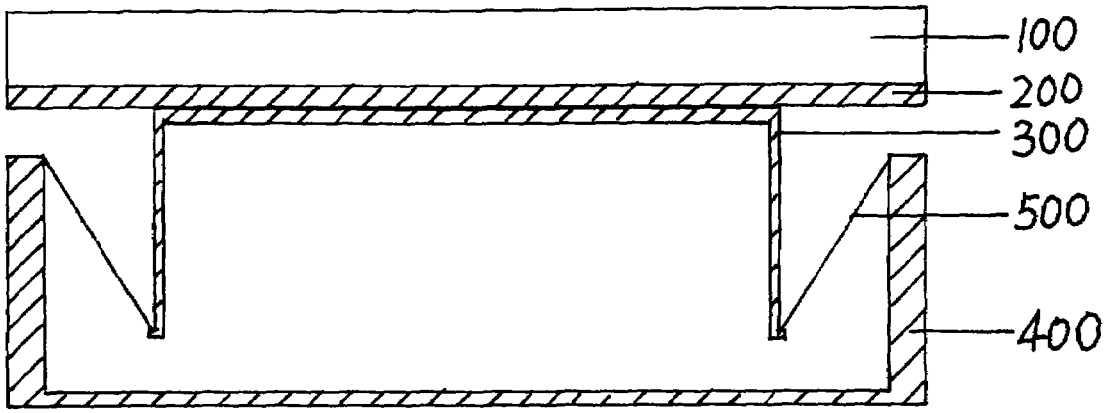
FIG. 4A is a schematic representation of means of connection of skeleton and foundation by cables and FIG. 4B is a transverse section view at middle of the bed, and is a means of the connection of skeleton and a motor of the first exemplary embodiment, which provide transverse reciprocal motion for the bed of FIG. 1.
Figure 4B:
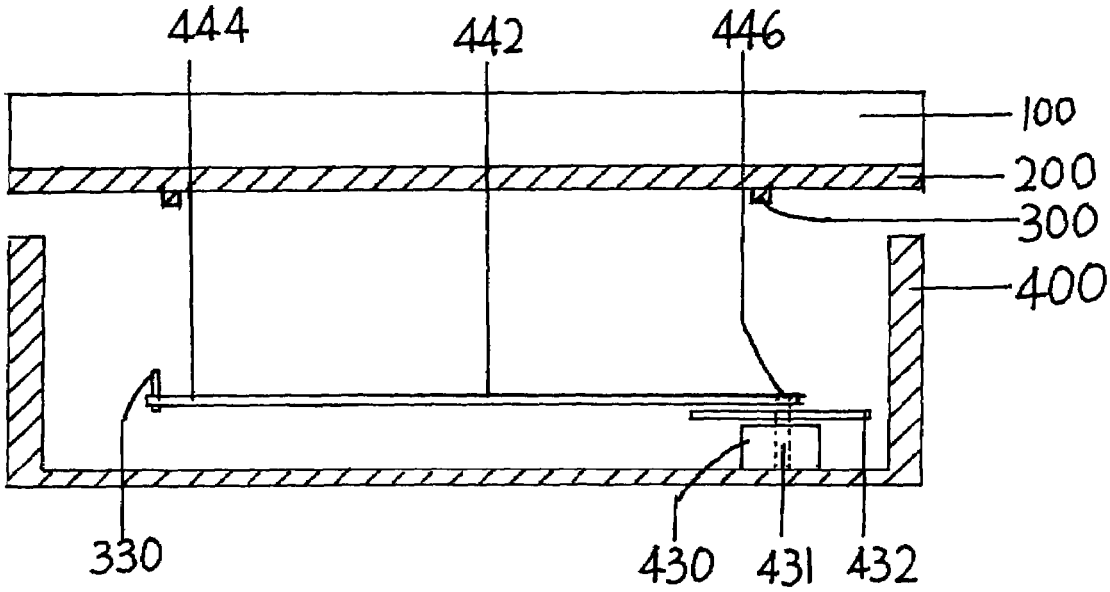
Figure 5:
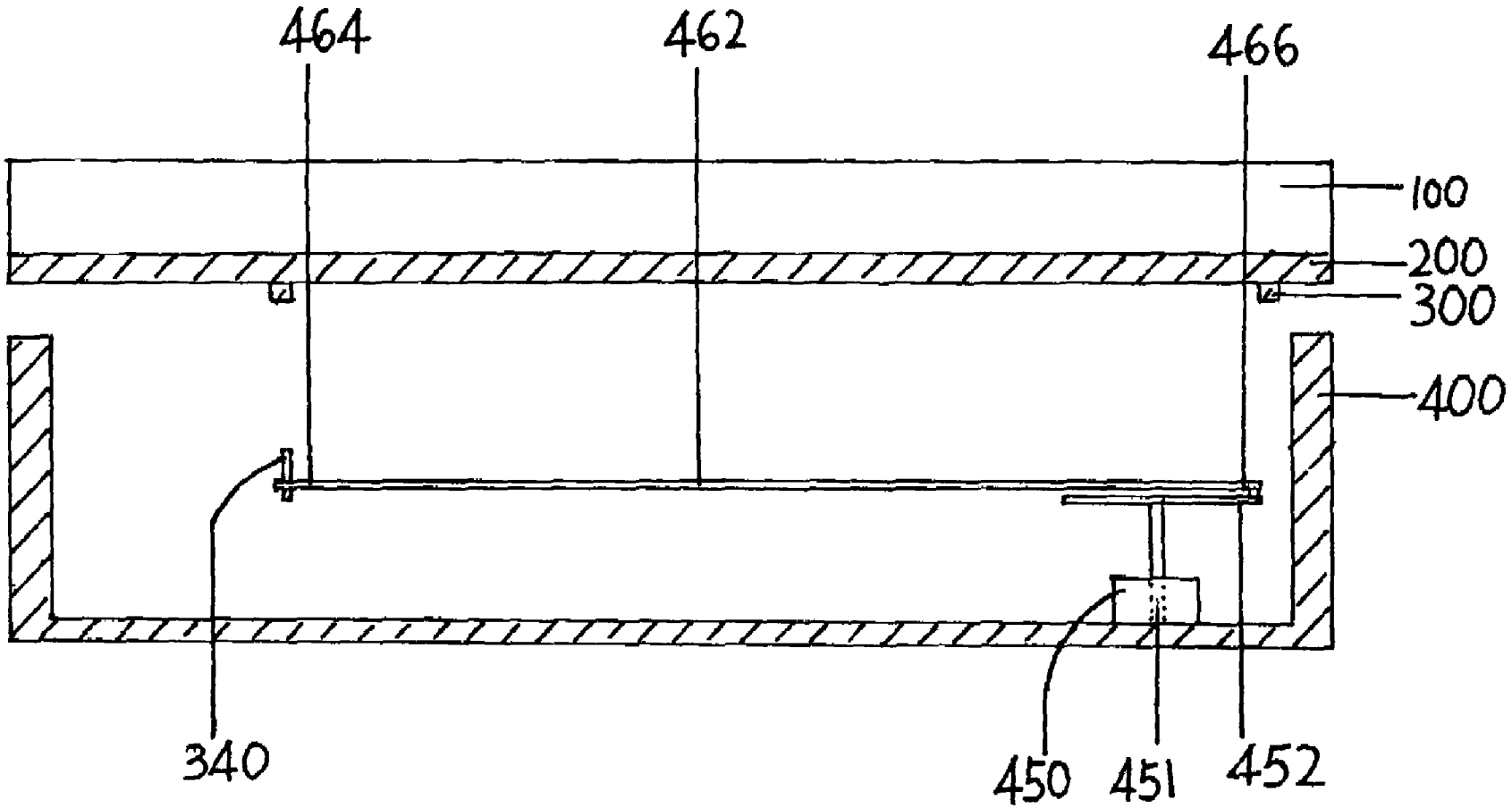
FIG. 5 is a schematic representation of means of relationship of skeletons and foundation in longitudinal direction at the condition of non-working state and the connection of skeleton and a motor of the exemplary embodiments, which provide longitudinal reciprocal motion for the beds of FIG. 1 and FIG. 8.
Figure 7:
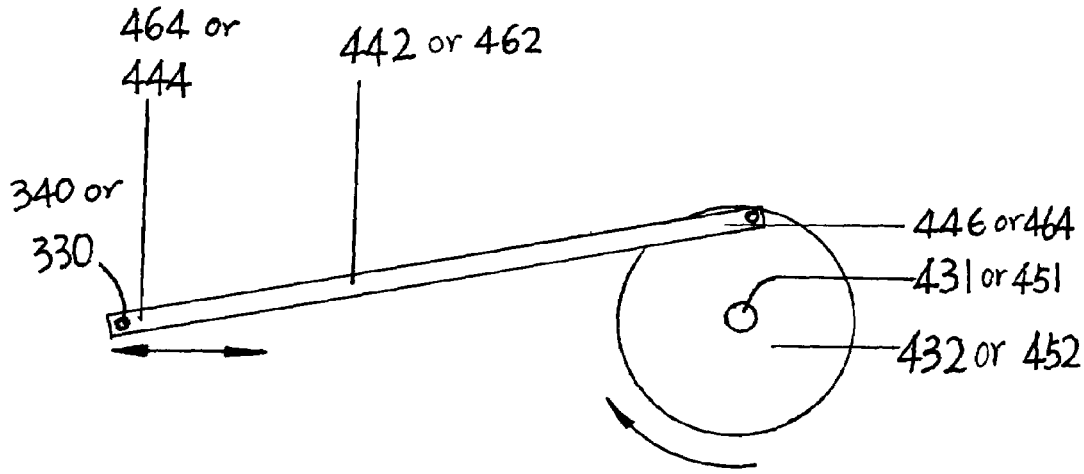
FIG. 7 is a schematic representation of the motive force of FIG. 4B, FIG. 5 and FIG. 11B.
Figure 8:
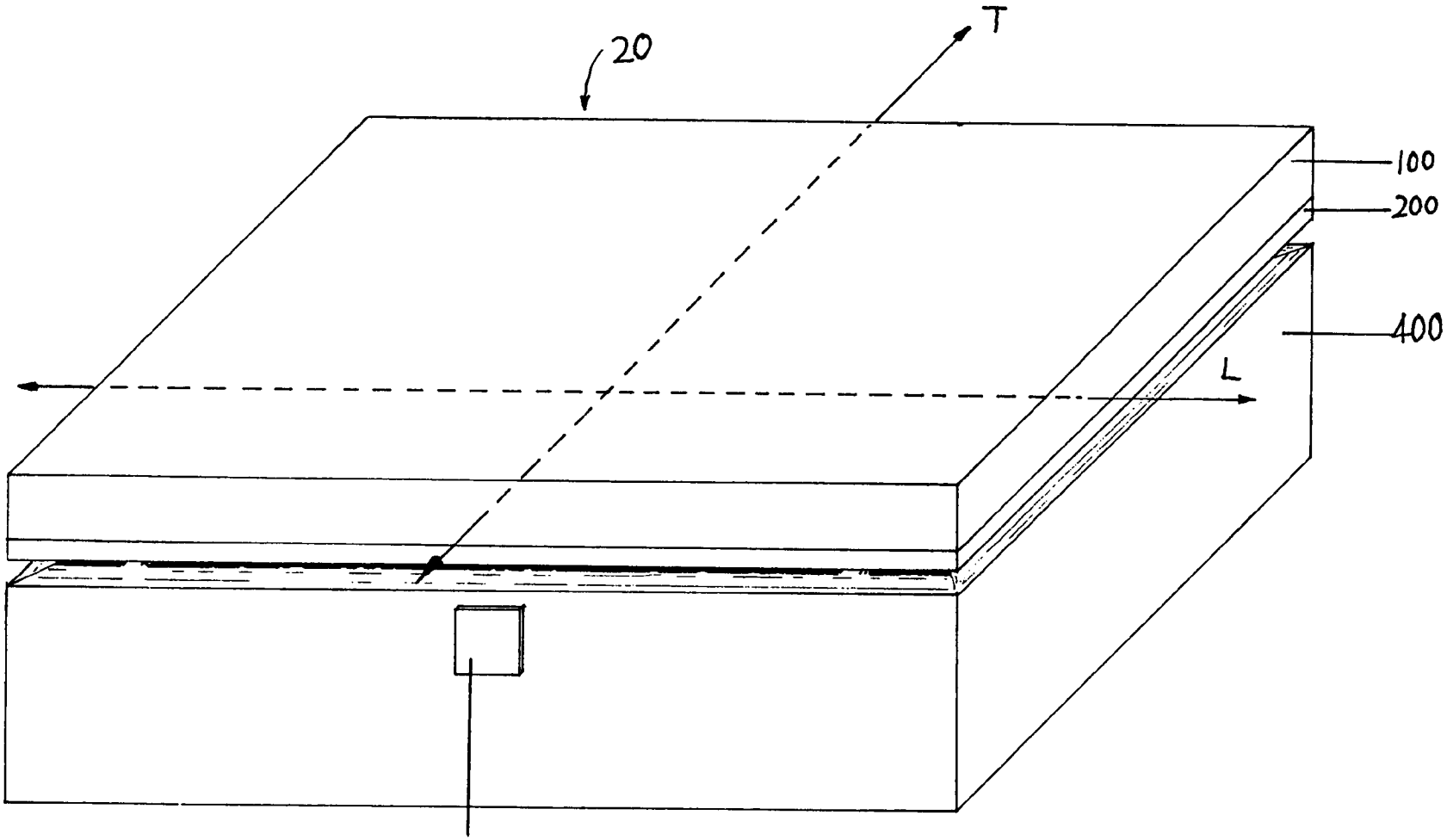
FIG. 8 is a perspective view of a second exemplary embodiment of the bed.

Drive mechanism includes two motion devices that drives the skeleton to move fro and to in longitudinal direction and transverse direction separately and are showed separately on FIG. 4B and FIG. 5. As seen in FIG. 4B, first motion device includes linkage arm 442 having a first and second end 444, 446, a disc-shaped member 432 and an electric motor 430. The first end 444 of the linkage arm 442 is connected to the linkage pin 330 fixed or screwed to the skeleton 300. The second end 446 of the linkage arm 442 is connected to a disc-shaped member 432 which connected to and supported on a drive shaft 431 of the electric motor 430. In operation, as shown in FIG. 7, as the disc-shaped member 432 rotates, the linkage arm 442 is drawn in such a path that the linkage pin 330 and the skeleton 300 is pushed/pulled in a transverse direction. As seen in FIG. 5, second motion device includes linkage arm 462 having a first and second end 464, 466, a disc-shaped member 452 and an electric motor 450. The first end 464 of the linkage arm 462 is connected to the linkage pin 340 fixed or screwed to the skeleton 300. The second end 466 of the linkage arm 462 is connected to a disc-shaped member 452 connected to and supported on a drive shaft 451 of the electric motor 450. As seen in FIG. 5, the drive shaft 451 is preferably oriented above to the upper level of the linkage arm 442 of the first motion device. In operation, as shown in FIG. 7, as the disc-shaped member 452 rotates, the linkage arm 462 is drawn in a path such that the linkage pin 340 and the skeleton 300 is pushed/pulled in a longitudinal direction.

As seen in FIG. 3, the foundation 400 is an open box-like structure. The box conceals the drive mechanism of two devices and skeleton 300. Therefore, when fully assembled, the bed 10 may appear similar to any other bed arrangement.

Figure 12A:
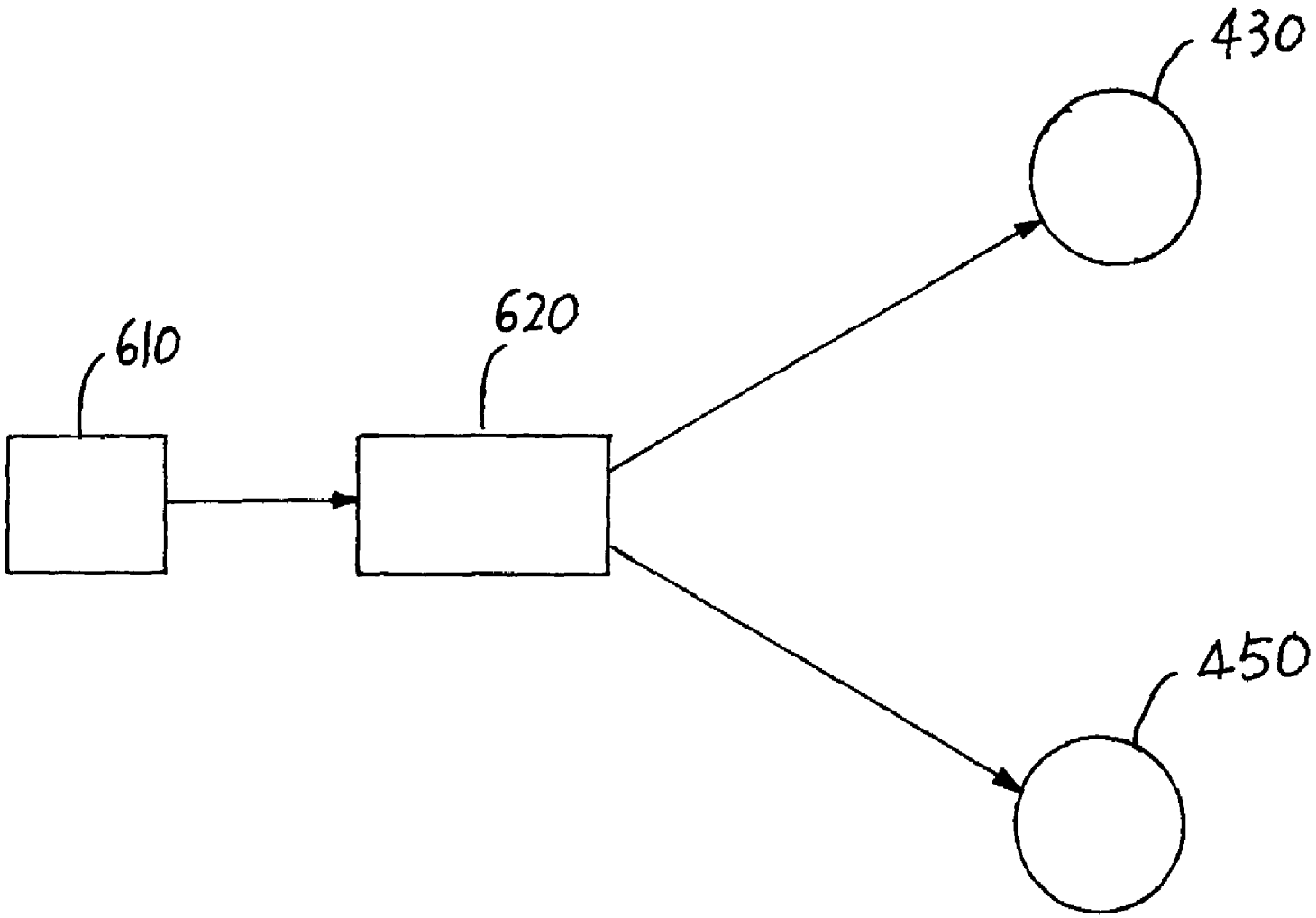
FIG. 12A is a schematic representation of an exemplary control scheme for the motion of the bed of FIG. 1 and FIG. 8. 12B shows exemplary motions of a mattress in a horizontal plane based on parameters of the control scheme. 12C shows exemplary seesawing motion component of reciprocal comprehensive motion (three dimensions motion+seesawing motion) of a mattress. 12D shows counter-seesawing motion form.
Figure 12B:
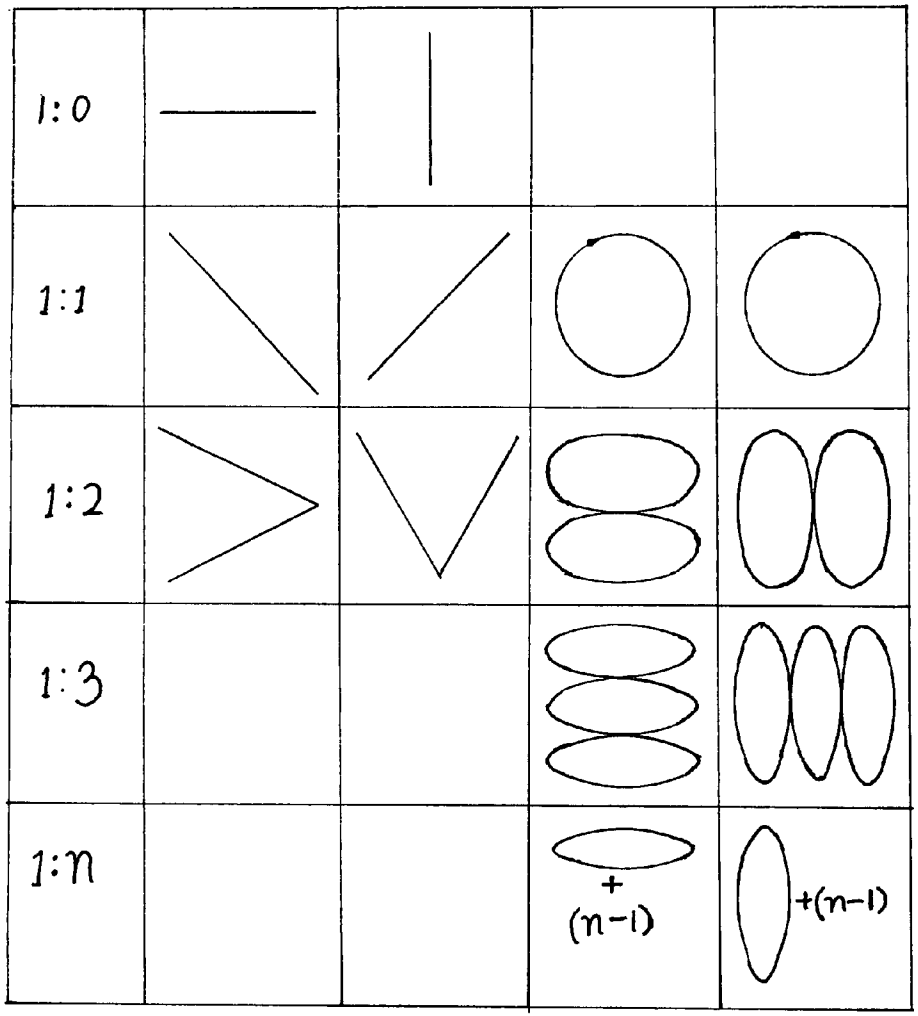
Figure 12C:
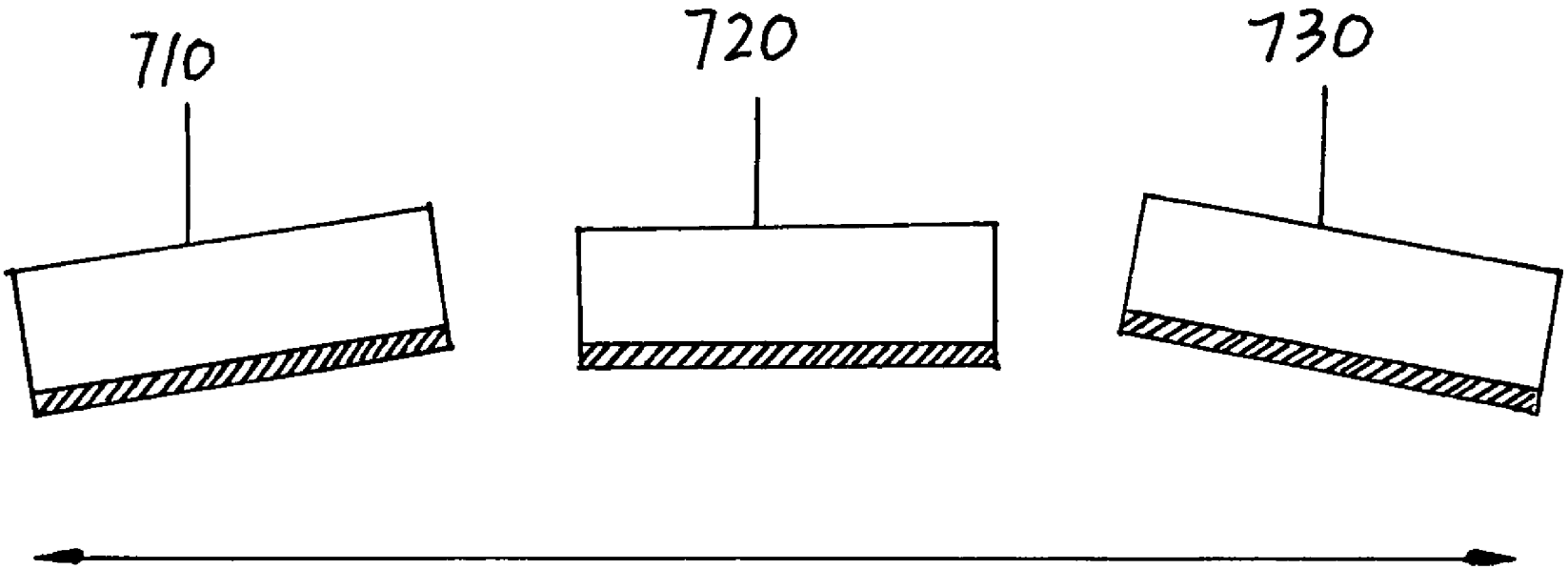

As seen in FIG. 12B, for this exemplary embodiment, the actual motion form of the mattress is a comprehensive motion form. The comprehensive motion is determined by: (1) longitudinal motion of the mattress when motor 450 works; (2) transverse motion of the mattress when motor 430 works; (3) vertical up and down motion of the mattress plane when the motor 450 works; (4) transverse seesawing motion of the mattress when motor 430 works (see FIG. 12C). The comprehensive motion of the mattress is three dimensions even when only one motor works and, what is more, the comprehensive motion form of mattress is three dimensions+seesawing motion when only the motor 430 works. When the two motors works together the comprehensive motion form is also three dimensions+seesawing but it is a more complex comprehensive motion form. Such the stimulation to vestibular organs is more effective.

FIGS. 8, 9, 10 and 11 show a second exemplary embodiment of the bed 20. In this embodiment, the skeleton and the foundation have been modified or have specific structures so that the cables are vertical rather than slanted in the view of transverse section when the bed is at the lowest potential state which is a state when the bed is not in working condition.

Figure 9:
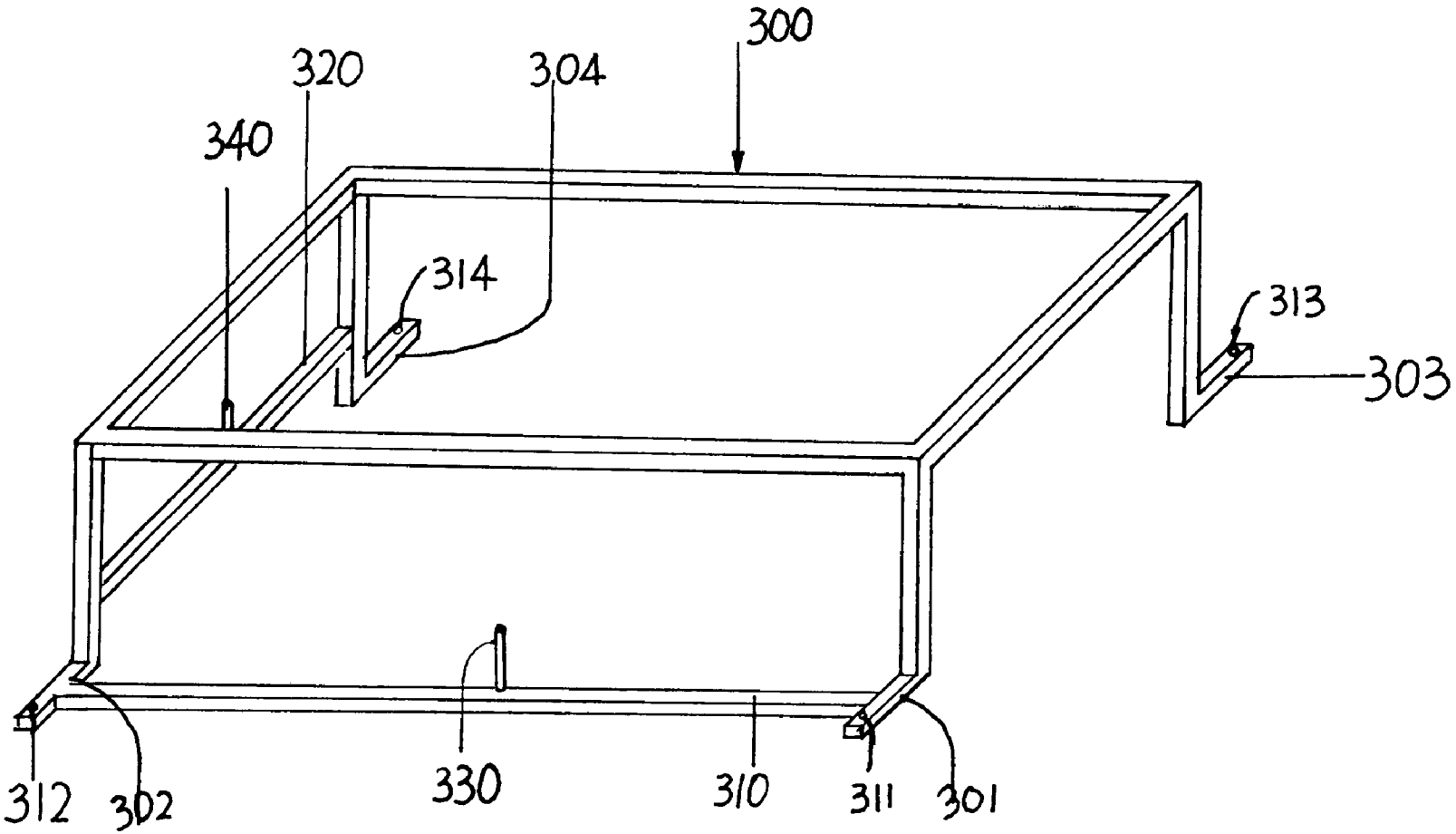
FIG. 9 is a perspective view of a second exemplary embodiment of a skeleton for the bed of FIG. 8 looking from above.

As seen in FIG. 9, a second exemplary embodiment of the skeleton 300 is almost the same as the first exemplary embodiment of the skeleton (see FIG. 2). The only difference is that the beams contained a hole is longer than that of the first exemplary embodiment of the skeleton (see FIG. 2) and the beams are numbered by 301, 302, 303 and 304, and that the 4 holes numbered by 311, 312, 313 and 314 are far away from a long axle line. This modified structure of the skeleton and modified structure of foundation described as follow make the cables vertical at the view of transverse section when the bed is at the lowest potential state.

Figure 10:
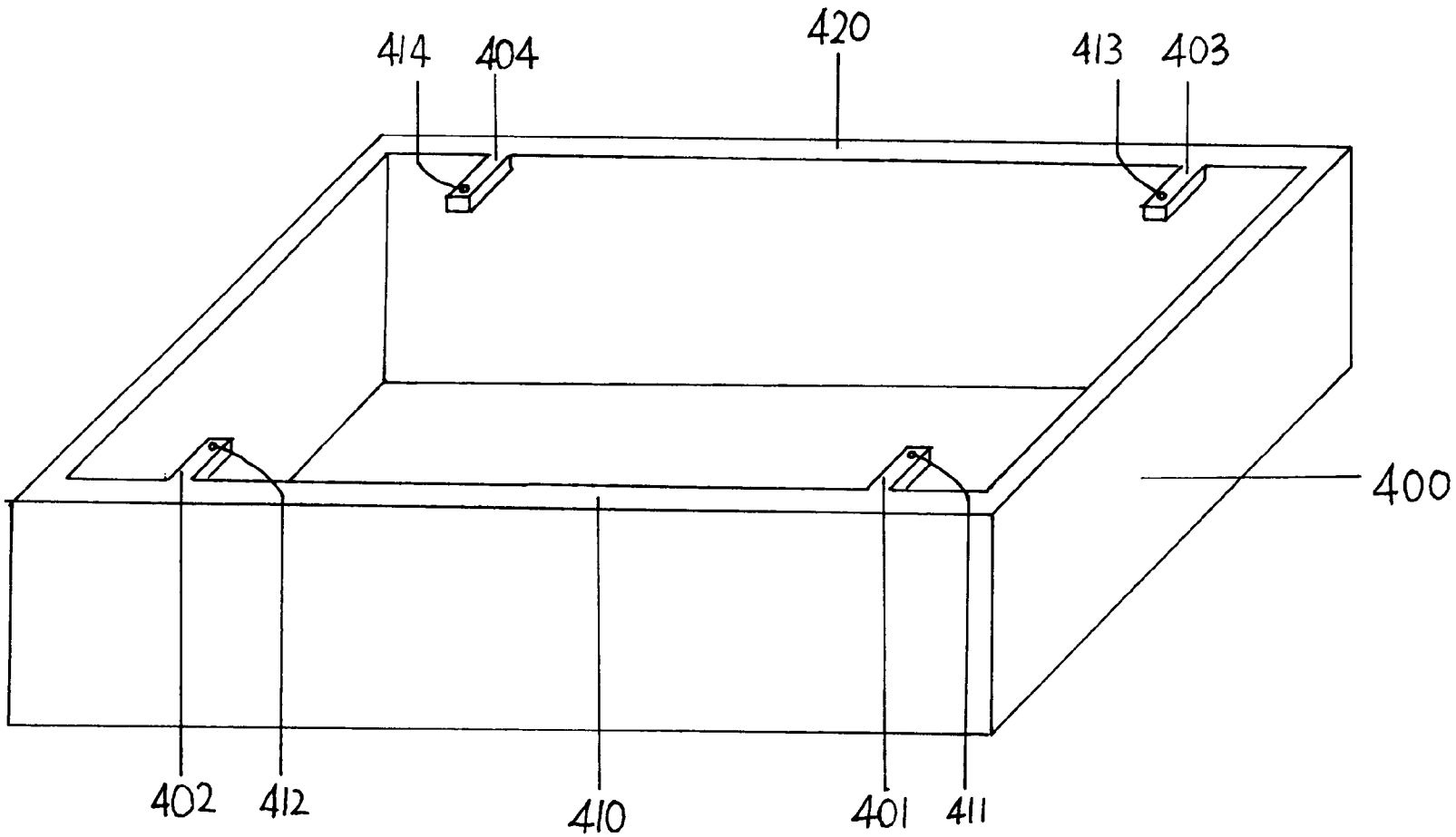
FIG. 10 is perspective views of a second exemplary embodiment of an foundation for the bed of FIG. 8 looking from above.

As seen in FIG. 10, a second exemplary embodiment of the foundation 400 is almost the same as the first exemplary embodiment of the foundation (see FIG. 3). The only difference is that there are 4 sticks at the inner superior positions of both of opposite long planks 410 and 420 of the bed 20. The 4 sticks are numbered as 401, 402, 403 and 404. Each stick has one hole at its free end. There are totally 4 holes numbered as 411,412, 413 and 414. The 4 sticks on the foundation that are arranged as seen in FIG. 10 and the 4 beams on the skeleton that are arranged as seen in FIG. 9 make the cables right vertical when the both end of cables connect with the holes on the sticks (FIG. 10) and on the beams separately (see FIG. 9).

Figure 11A:
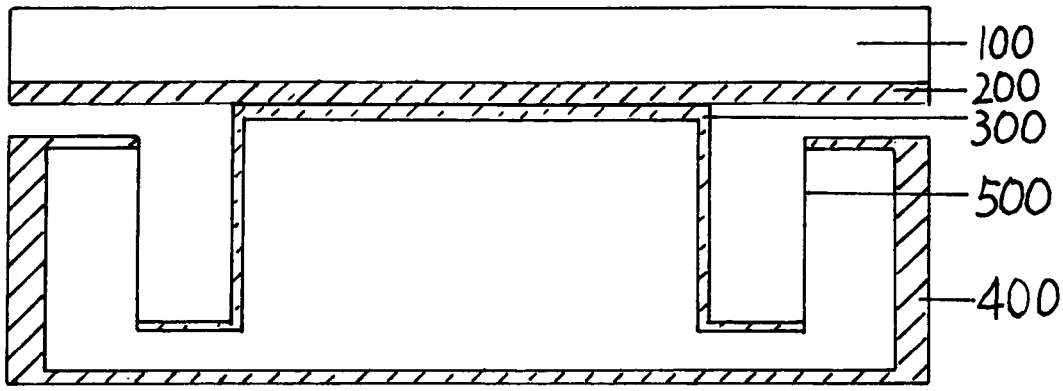
FIG. 11A is a schematic representation of a mean of connection of skeleton and foundation by cables and FIG. 11B is a transverse section view, and is a mean of the connection of skeleton and a motor, which provides transverse reciprocal motion for the bed of FIG. 8.

As seen in FIG. 11A, the cables 500 are right vertical at the transverse view and the structure of the verticality of cables decides the mattress plane is always parallel to floor when bed works (there is no seesawing motion for the second embodiment).

Figure 11B:
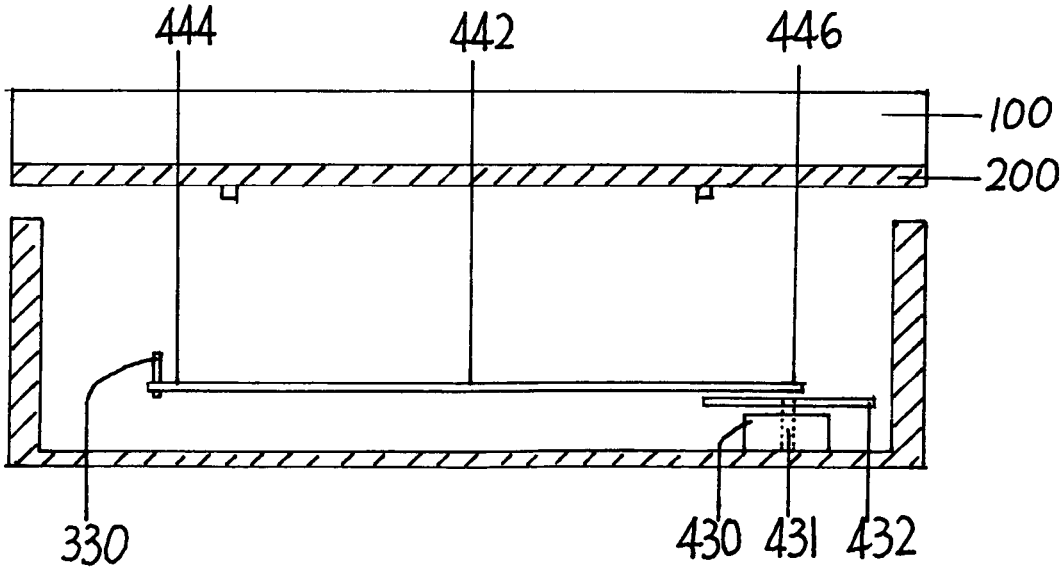

For a second exemplary embodiment, the drive mechanism also includes two motion devices that drive the skeleton to move fro and to in longitudinal direction and transverse direction separately and are showed separately on FIG. 5 and FIG. 11B. The structure and the working principle of the motion device of the second exemplary embodiment are the same as that of the first exemplary embodiment (see the description of the paragraph 0039).

As seen in FIG. 12B, for the second exemplary embodiment, the actual motion form of mattress is also a comprehensive motion form. The comprehensive motion is determined by three components: (1) longitudinal motion of mattress when motor 450 works; (2) transverse motion of mattress when motor 430 works; (3) vertical up and down motion of mattress plane when the motor 450 works or/and when the motor 430 works. So when only one motor works, the motion of mattress is three dimensions; of course, when the two motors work simultaneously, the comprehensive motion form is not only three dimensions but is more complex. Thus the stimulation to vestibular organs is more effective.

In operation either exemplary embodiment of the bed 10 or 20, a user may vary the motion form by choosing input parameters into a control module. FIG. 12A shows an exemplary arrangement where a user inputs control parameters into a control module 620 via user input device 610. The control module 620 sends control signals to electric motor 430 and electric motor 450. For purposes of this invention, the user may be the individual lying on the mattress 100 or an operator controlling the bed 10 or 20 for the benefit of the individual lying on the mattress 100.

The parameters include frequency of oscillation of the mattress 100 including the liner when one motor works or oblique when two motors work or circular when two motors work simultaneously, the alteration of motion form and duration of oscillation of the mattress 100. User input device 610 may be either a control panel or a remote device configured to receive user inputs and transmit the inputs to control module 620. The control module 620, in turn, converts the user inputs into control signals to the appropriate electric motor(s) 430, 450.

FIG. 12B shows horizontal various oscillating motions of the mattress and the plate supporting the mattress and sitting on the skeleton that the bed 10 or 20 may perform based on input parameters from a user. Exactly, FIG. 12B shows the relationship between the ratio of frequency of rotation of two motors and the horizontally planar motion form of the comprehensive motion. First column shows the ratio of the frequency of the rotation of the two motors and the second, third, fourth and fifth columns shows the horizontally planar motion forms of the comprehensive motion. The rows show that the bed 10 and 20 can carry out the horizontally planar motion forms of the comprehensive motion under a condition of a certain ratio of the frequency of the rotation of the two motors. The motion form is determined by the ratio of the frequency of the rotation of the two motors and the initiative position of the plate at the time when the bed start regular work. The motion may be as simple as moving back and forth in only one direction (i.e. in the transverse direction or in the longitudinal direction) or in a complicated path involving many elliptical oscillations. The user may adjust the parameters to find the motion form they like and may most conducive to sleep (i.e., most conducive to the sleep initiation and maintenance).

Figure 12D:
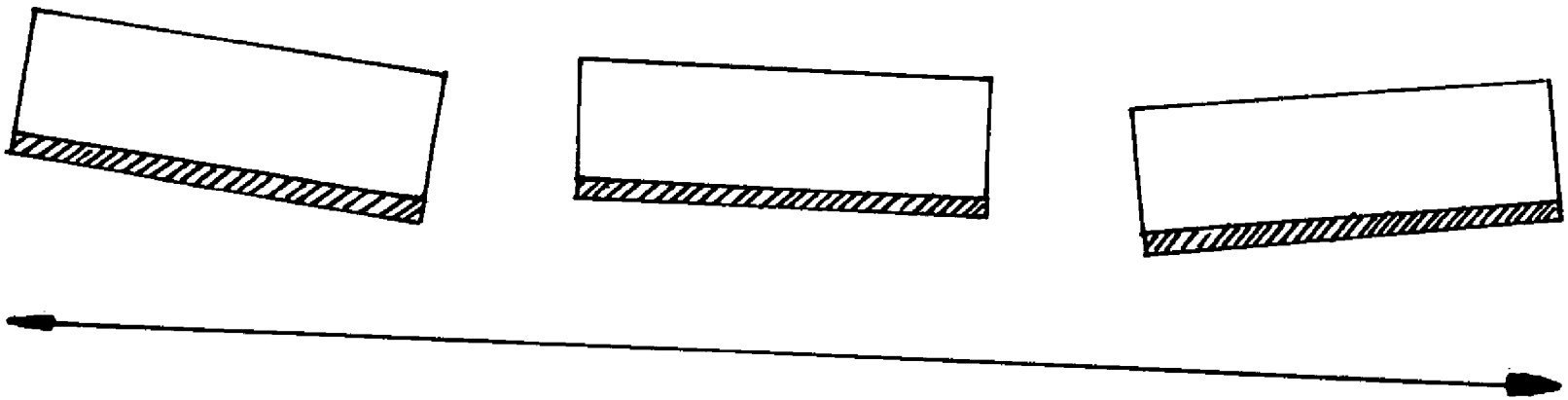

While the above description contains my specifications, the reader should not consider these as limitations on the scope of the invention, but merely as exemplifications of certain embodiments thereof. The invention thus being described, it will be apparent that the same may be varied in many ways. For example, electric motor 430 and 450 can be replaced with a linear actuator or any other device that is configured to move plate in a transverse and longitudinal direction. We may alter the length of sticks 401, 402, 403 and 404 fixed on the foundation 400 (see FIG. 10) and of the beams 301, 302, 303 and 304 on the skeleton 300 (see FIG. 9) so that the cables are slanted at various degree from inner superior position to outer inferior position, then the seesawing motion will be different, such as that showed on FIG. 12D (we may call it as counter-seesawing motion). The seesawing motion of the first exemplary embodiment is in the transverse view, however, if design the cables to be suspended in other two sides the seesawing motion will be in the longitudinal view. We may install the cables at 4 corners. Thus, theoretically, seesawing motion can be created both in the transverse view and in the longitudinal view and the actual motion form of the mattress will be more complex. When the length of the cables varies, the degree of the vertical up and down motion and the seesawing motion will change too. We may design 4 high feet so that cables are installed from top of the feet to the bottom of the plate. We may use springs or shock absorbers to replace cables to support plate. We may replace the driving wheel by a crankshaft. The amplitude of oscillation of the mattress can be changed by the size of driving wheel 432 and/or 452. Such the variations and their deviations are not to be regarded as a departure from the spirit and scope of the invention, and all such modifications as would be obvious to one skilled in the art are intended to be included within the scope of the following claims.

What is claimed are:

1. An apparatus for effecting a rhythmic reciprocal comprehensive movement of a bed comprising:

a foundation configured to support all other components of the bed; and a skeleton configured to be suspended in the air by cables and support a plate; and a plate configured to support a mattress; and a mattress configured to provide a comfortable surface for body or bodies; and a plurality of cables configured to suspend said skeleton in the air; and a first motion device located on the bottom of the foundation and connected to said skeleton, the first motion device configured to move the skeleton in a transverse direction with respect to the foundation; and a second motion device located on the bottom of the foundation and connected to said skeleton, the second motion device configured to move the skeleton in a longitudinal direction with respect to the foundation;

a control device configured to control both said first motion device and said second motion device to provide rhythmic reciprocal comprehensive movement;

wherein the combination of movement in the transverse direction and the longitudinal direction provides a planar rhythmic reciprocal comprehensive movement.

2. The apparatus of claim 1, wherein each cable comprises:

two ends that separately connect with the skeleton and foundation configured to suspend the mattress and the plate in the air through said skeleton; and a length adjustor configured to adjust the amplitude of the motion component of the vertical direction of three dimension motion and seesawing motion;

wherein said skeleton is suspended in the air;

wherein said plate can perform a vertical up-down movement when the plate supported on said skeleton makes horizontal movement driven by motor device(s).

3. The said cable of claim 2, further comprising:

a joint device configured to make the cables to wave smoothly.

4. The apparatus of claim 1, further comprising means of the cables being vertically installed on free ends of beams fixed on an outer inferior position of two opposite sides of said skeleton and on free ends of sticks fixed on an inner superior position of two opposite sides of said foundation;

wherein said skeleton is suspended in the air;

wherein said plate can perform a vertical up-down movement when said plate supported on said skeleton makes horizontal movement driven by motor device(s).

5. The apparatus of claim 1, the means of the cables being slantways installed on an outer inferior position of opposite sides of the skeleton and on an inner superior position of opposite sides of the foundation;

wherein said skeleton is suspended in the air;

wherein said plate has ability of performing a seesawing movement when said plate supported on said skeleton makes planar movement driven by motor device(s).

6. The apparatus of claim 1, wherein said control device comprises:

a control panel that is for users to set parameters of said rhythmic reciprocal comprehensive movement;

a remote control device which is for users to adjust parameters of the said rhythmic reciprocal comprehensive movement; and a control module configured to receive the inputs and transmit the inputs to said driving device(s).

7. The said control device of claim 6, further comprising means for controlling the frequency, the motion form, the alteration of motion form and a time period of the said rhythmic reciprocal comprehensive movement.

8. The said first motion device and said second motion device of claim 1, wherein each of them comprises:

an electric motor having a rotating shaft; and a power transmission component configured to connect said rotating shaft and the skeleton, the power transmission component converts rotational movement of the rotating shaft into a liner reciprocal movement of the skeleton.

9. The apparatus of claim 8, wherein the power transmission component further comprising:

a driving wheel driven by the electric motor; and a linkage arm both ends of which connect with a driving wheel and skeleton separately.

10. The apparatus of claim 9, comprising means of change of rotation of motor shaft into liner reciprocal motion.

11. The skeleton of claim 1, comprising:

bench-shaped structure configured to provide a top surface for said plate to sit on; and beams between two extremities configured to provide position for a pivot to fix; and beams at the lower end of extremities configured to provide position for one ends of said cables to connect to and determine the degree of slant of said cables.

12. The apparatus of claim 1, wherein the foundation comprises:

a box-shaped structure; and a plurality of sticks having an end that is fixed at the inner superior position of two opposite sides of the box-shaped structure configured to provide a connecting position for cables.

13. The apparatus of claim 12, wherein the foundation further comprises:

a bottom with a structure configured to provide positions for motors to be installed.

14. The apparatus of claim 1, wherein the plate supported on said skeleton configures to support a mattress.

15. A bed according to claim 1, further comprising a mattress supported by the plate.

16. A bed according to claim 14, wherein the means for displacing the plate in a longitudinal direction and the means for displacing the plate in the transverse direction cooperate to displace the plate in a plane generally parallel to the ground moving in a horizontal direction only.

17. A bed according to claim 2, wherein the means for displacing the plate in a longitudinal direction, and the means for displacing the plate in the transverse direction, and the means for suspending the plate in the air cooperate to make said plate rhythmic comprehensive reciprocal movement at the same time;

wherein said rhythmic comprehensive reciprocal movement comprises:

a planar motion component of the mattress surface in a transverse direction;

a planar motion component of the mattress surface in a longitudinal direction;

a planar up-down motion component of the mattress surface in a vertical direction;

a seesawing motion of the mattress surface;

wherein the said rhythmic reciprocal comprehensive motion is manifested in a three dimensional movement including "seesaw" type movement.

18. The bed of claim 17, wherein the said rhythmic reciprocal comprehensive motion is operable for assisting ventilation of the user, supporting ventilation of the user or users, and providing cardiopulmonary, cardiac vestibular and blood circulation support for the user or users, and preventing from bedsore/pneumonia.

19. The bed of claim 17, wherein the said rhythmic reciprocal comprehensive motion is operable for the benefit of person with high blood pressure, diabetic, palpitation by stimulation of parasympathetic divisions.

* * * * *